US011318062B2

(12) United States Patent
Almendarez

(10) Patent No.: US 11,318,062 B2
(45) Date of Patent: May 3, 2022

(54) EXERCISE DEVICE

(71) Applicant: Javier Almendarez, Hammond, IN (US)

(72) Inventor: Javier Almendarez, Hammond, IN (US)

( * ) Notice: Subject to any disclaimer, the term of this patent is extended or adjusted under 35 U.S.C. 154(b) by 577 days.

(21) Appl. No.: 16/181,891

(22) Filed: Nov. 6, 2018

(65) Prior Publication Data

US 2019/0133865 A1 May 9, 2019

Related U.S. Application Data

(60) Provisional application No. 62/583,631, filed on Nov. 9, 2017.

(51) Int. Cl.
*A61H 1/02* (2006.01)
*A61H 1/00* (2006.01)

(52) U.S. Cl.
CPC ..... *A61H 1/024* (2013.01); *A61H 1/00* (2013.01); *A61H 2201/0119* (2013.01); *A61H 2201/1269* (2013.01); *A61H 2201/149* (2013.01); *A61H 2201/1436* (2013.01); *A61H 2201/1635* (2013.01); *A61H 2201/1642* (2013.01)

(58) Field of Classification Search
CPC .. A61H 1/024; A61H 1/00; A61H 2201/0119; A61H 2201/1269; A61H 2201/1436; A61H 2201/1635; A61H 2201/149; A61H 2201/1642; A61H 2201/5043; A61H 2203/0431; A61H 2205/10; A61H 2205/102; A61H 2201/0138; A61H 2201/0176; A61H 2201/14; A61H 2201/1633; A61H 1/0237; A61H 1/02; A61H 2001/0203; A61H 2001/0207; A61H 1/0214; A61H 1/0218; A61H 1/0222; A61H 1/0229; A61H 2001/0233; A61H 1/0262; A61H 1/0259; A61H 2201/0142; A61H 2201/0149; A61H 1/001; A61H 1/003; A61H 1/005; A61H 2001/0211; A61H 1/0255; A61H 2201/0146; A63B 21/0442; A63B 21/00065; A63B 21/00178; A63B 21/00185; A63B 21/4013; A63B 21/4029; A63B 2023/006; A63B 23/03508; A63B 21/00181

See application file for complete search history.

(56) References Cited

U.S. PATENT DOCUMENTS 951,515 A * 3/1910 Solsem ..... A61H 1/0218 606/241
3,602,501 A * 8/1971 Garner ..... A63B 23/00 482/145
3,905,295 A * 9/1975 Bielesch ..... B05C 17/023 101/331

(Continued)

*Primary Examiner* — Justine R Yu
*Assistant Examiner* — Kelsey E Baller
(74) *Attorney, Agent, or Firm* — Daniel Zamudio

(57) ABSTRACT

A machine that facilitates the performance of physical therapy exercises with or without the assistance of a physical therapist. The device allows a patient to sit upon a table, and connect the patient's body part to a cuff and pulling system. Then, via hand movements upon an article of the device cause body part flexion. Too, a patient can use the device for isometric like exercising via a series of stretch bands that attach to the cuff and table.

12 Claims, 4 Drawing Sheets

(56) References Cited

U.S. PATENT DOCUMENTS

| | | | | |
|---|---|---|---|---|
| 5,324,245 | A * | 6/1994 | Fontana | A61H 1/024 482/131 |
| 6,422,981 | B1 * | 7/2002 | Riser | A63B 21/154 482/142 |
| 6,592,502 | B1 * | 7/2003 | Phillips | A61H 1/0214 482/121 |
| 2011/0034307 | A1 * | 2/2011 | Eddy | A63B 21/4015 482/131 |
| 2014/0039360 | A1 * | 2/2014 | Spade | A61H 1/024 601/33 |
| 2014/0094352 | A1 * | 4/2014 | Best | A63B 21/0552 482/123 |
| 2014/0228186 | A1 * | 8/2014 | Montgomery | A63B 21/154 482/139 |
| 2017/0035638 | A1 * | 2/2017 | Koenig | A63B 21/4011 |
| 2017/0172836 | A1 * | 6/2017 | Johnson, Sr. | A61H 1/02 |

* cited by examiner

EXERCISE DEVICE

CROSS-REFERENCE TO RELATED APPLICATIONS

The present application claims the benefit of U.S. Provisional Patent Application No. 62/583,631, filed Nov. 9, 2017, the entirety of which is hereby incorporated by reference.

BACKGROUND

The need for physical therapy increased after several world events. World War II and a nationwide polio epidemic during the 1940s and 1950s caused the need for physical therapists to swell. Today, Americans are concerned about maintaining a longer healthier life and are often prescribed physical therapy for all that ails them, e.g., knee surgery, assistance with walking, and unexpected bodily injuries.

According to various sources, the number of physical therapy sessions for patients is tremendous and increasing.

There is a need in the industry for an apparatus that is easy to use, inexpensive, and assists humans in giving themselves physical therapy. A device that helps eliminate the need for a physical therapist to be at all times present for a person's PT session. An apparatus suited to the delivery of physical therapy exercises, such as flexion of the knee to name one example. The device can be equipped with monitoring devices, common in the industry, to track performance, a counter for instance.

SUMMARY

The present invention is directed to an apparatus that satisfies this need. A preferred embodiment of the device comprises a physical therapy table similar to that which is commonly known in the industry. A gear mechanism that is in an enclosed compartment and has gear ratios and directions suited to the physical therapy exercise to be performed. It comprises having the gear mechanism attached to the table, with nuts and bolts for example. The device has a pulley system that would include cabling, optional pulleys, clips for attaching, and other common items used with such a pulley system. The pulley system would have a cable that identifies a proximate end, in relation to the table, and a distal end. The proximate end being attached to the gear mechanism such that when the gears operate the cable moves. The pulley system is also attached to a band, a cuff for instance, at the distal end. The band is attached to a patient's body, at the calf for instance.

In this way, the inventive embodiment of the device is used to allow a patient to control flexion of the knee with little or no assistance from a physical therapist. The patient moves the handle that controls the gears, the cable moves along its path and, being connected to a calf via a band, moves the patient's leg; Bending the leg at the knee.

Another embodiment of the present invention is an exercise device with a table. Such a table is commonly seen in doctor or therapist offices and referred to commonly as a patient table. The device includes a bracket which is any size or shape and can be an enclosed container or merely flat metal piece with commonly known configurations for fastening an article.

The device has a fastening mechanism. This can be a group of screws, nails, adhesive, or any appropriate fastener. The bracket then is attached to the table via the fastening mechanism. A force transferring mechanism is included and attached to the bracket. This attachment may be via a pin or a bearing apparatus to allow for rotational movement. Interesting to me is that the force transferring mechanism can be a gear and pulley setup or even a plurality of gears interconnected by a commonly known chain, to name two examples of such a mechanism.

A handle is attached to the force transferring mechanism. This allows a user to grasp the handle and control the force transferring mechanism with great precision. This is important because a cable is attached at one of the force transferring mechanism's ends, a first end, to the force transferring mechanism.

The force transferring mechanism is made of articles generally known in the industry. These articles could include gears, pulleys, or levers to name a few examples. These would be present in one or more pieces and configured in any one of a multitude of ways. The purpose being to allow the transfer of force from the user during operation of the device via its handle.

In an embodiment there may be a pulley attached to the table, at a location that is appropriate for the particular installation. I have found it best, when a pulley is used, if the pulley is attached to a leg of the table at some point diagonally away from the force transferring mechanism. The device has a cuff which is equipped with places to attach cables, wires, ropes, bands or the like. This embodiment has a cable connecting ring and a band connecting ring. These are essentially loops of durable material for attachment.

In one preferred embodiment, the cable passes through the pulley wheel. It then attaches at a second end to the cable connecting ring. The table, usually of the four legged type, has a bar connected between two of its legs, best if these are the rear legs of the table. There is at least one bar connecting ring attached to the bar.

The embodiment has at least one band with a first band end and a second band end. The first band end is connected to one of the at least one bar connecting rings. The connection of this end to the ring is done in a way that is commonly known, snap rings, loop and hooks, or even a mere wrap and tie method to name a few examples.

The second band end of the at least one band is connected to the band connecting ring, again the connection is done in a commonly known fashion.

I have discovered that the table, along with the preceding parts and pieces, is capable of allowing a user to sit upon the table and attach the cuff to one of the user's body parts, such as a leg near the ankle. The handle is capable of altering the position of the body part as the position of the handle is altered by the user. So, for instance, pushing the handle in one direction would cause flexion in the leg, and letting it back would allow the leg to return to its resting position.

Additionally, an embodiment of the present invention could have a force transferring mechanism that is rotate-ably attached to the bracket, such as by a pin and retainer clip. This allows the force transferring mechanism, a gear to name one example, to rotate around one of its axes. The muscles of the body part being stretched when the handle alters the position of the body part. Obviously, such a device is useful for performing physical therapy exercises. The body part, a leg, moves by the device exerting pressure against muscles of the leg to increase flexion. This is a substitute for a physical therapist performing muscle stretches in person, a user can use such a device and perform the flexions without another person.

An embodiment of such a device allows the leg to move posteriorly as the position of the handle is altered by the user increasing the flexion of the knee. The user pushes the handle forward, away from the table for instance, and the leg is pulled backward into a position of flexion. Of course, there are stops on the handle to prevent the handle from moving too far and causing injury. This is important because such a device can be configured such that the handle can be moved in small increments while the body part is flexed in larger increments in comparison to the amount the handle is moved, move the handle an inch and maybe the leg will move three inches.

I envision an embodiment where a table can be equipped for use from a users right hand or left hand and attached to a left body part, a leg for instance, or a right body part. Essentially, the table can be equipped to allow a user to perform therapeutic exercises to both legs at a single time if so desired. However I found the preferred embodiment is to operate on one body part at a time. Thus, the exercise device can be configured according to a configuration chosen from the group consisting of left hand configuration, right hand configuration, or both left and right hand configurations at the same time.

Certainly, an embodiment of the invention allows for a user performing static and dynamic flexion on their body part. Static flexion, moving and keeping the body part in a flexed position, of a muscle of the body part uses a pin that retains the position of the handle. An embodiment of the device could have a counter to monitor how many times flexion of the body part occurs. This would help a user to keep track of their exercises.

Yet another embodiment of the present invention is an exercise device that has a table, a bracket and a fastening mechanism. The bracket is attached to the table via the fastening mechanism, by bolting for instance. A force transferring mechanism is attached to the bracket. This force transferring mechanism is a sort of pulley system made up of at least two gears. The gears are interconnected in the best situation via a chain that is connected to the teeth of the gears.

There is also a handle that is attached to the force transferring mechanism, usually to one of the gears that are part of the mechanism. There is a cable and a cuff. The cuff having a cable connecting ring and also a band connecting ring. Though there may be variations on the cuff and numbers and types of rings the cuff has, I found the best to be a cuff with on of each ring type.

The cable is attached at its first end to the force transferring mechanism and at its second end to the cable connecting ring. Because, as in other embodiments, the table is sturdy, shaped and sized sufficiently it allows a user to sit upon the table and attach the cuff to a body part of a user. The handle then can be used to alter the position of the body part as the position of the handle is altered by the user.

Too, in this embodiment, there can be a bar connected between legs of the table and at least one bar connecting ring attached to that bar. There is at least one band, which has a first band end and a second band end, connected to one of the at least one bar connecting rings. The second band end being connected to the band connecting ring of the cuff.

Another embodiment of the device comprises a main portion, a plurality of gears, a hold, a pulley, a cable, and a leg attachment. The gears being attached to the main portion. The leg attachment is attachable and detachable to a body part, a person's leg at the calf to name one example. The cable having a gear end. The cable having a distal end. The distal end being connected to the leg attachment. The cable traversing the pulley, the pulley being locatable at different positions so as to help achieve maximum flexion. The plurality of gears being interconnected. The gear end being connected to one of the plurality of gears. The hold being attached to another of the plurality of gears. The hold operating the gears and causing the gears to operate the cable which thereby moves the attachment.

For instance, a user can move the hold in one direction, causing cable movement around the pulley which moves the attachment. A user having the attachment connected to his calf would then experience flexion. The main portion being removably attached to a physical therapy table.

BRIEF DESCRIPTION OF THE SEVERAL VIEWS OF THE DRAWINGS

These and other features, aspects and advantages of the present invention will become better understood with regard to the following description, appended claims, and accompanying drawings where:

DESCRIPTION

Overview.

Figure 1:
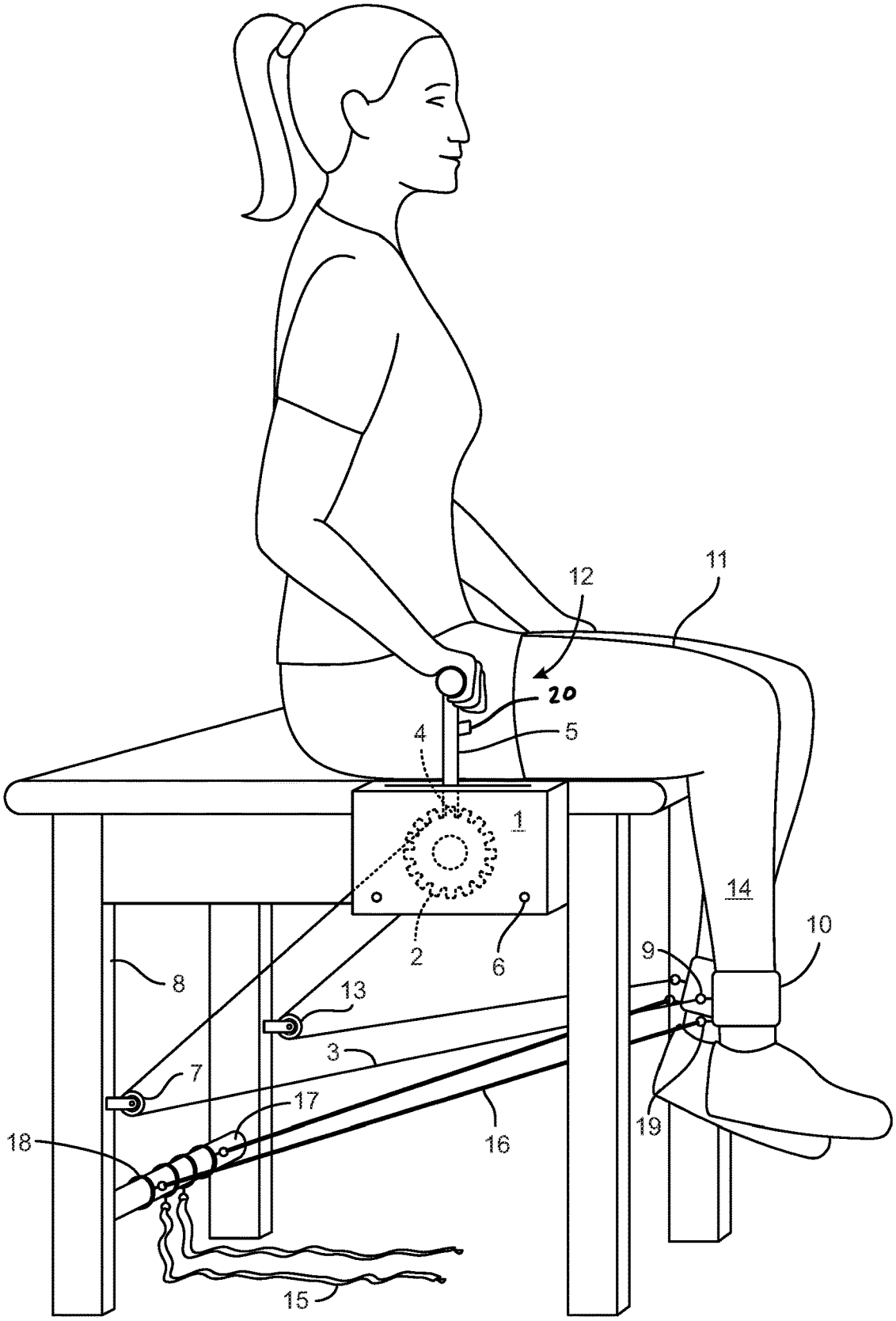
FIG. 1 shows a perspective view of an embodiment of the device in use by a patient.

As shown in FIG. 1, a perspective view of an embodiment of the device in use by a patient comprises a patient 11 seated upon a physical therapy table 8. The patient operates a handle 5 that operates a gear 2, a force transferring mechanism, which is attached to a bracket 1 via a commonly known fastener (not shown). The bracket 1 is attached to the table 8 via at least one bolt 6, which is a fastening mechanism. A cable 3 is attached to the gear 2 via a connector located at a connection point 4. When the user exerts force 12 the handle 5 will move and transfer the moving force. The handle 5 is equipped with a stop 20 to prevent the user from pushing the handle 5 too far. The cable 3 is moved along its path, which includes at least one pulley 7 (or 13 if there is another cable which might occur in a left handed configuration of the device). The at least one pulley 7 being locatable in different positions on the table 8. The cable 3 is attached at one end to a cuff 10 via a cable connecting ring 9. The cuff 10 being removably attached to a limb 14 of the person 11. Operating the device as shown 12 allows the person 11 to control movement of the limb 14.

Additionally as shown in FIG. 1, a bar 17 is connected between the rear legs of the table 8. There are bands 15, 16 connected to the bar via at least one bar connecting ring 18. These bands are best if they are the type that are stretchable and commonly used in muscle exercise movements. The bands 16, 15 can attach to the cuff 10 at one or more of the band connecting rings 19.

Figure 2:
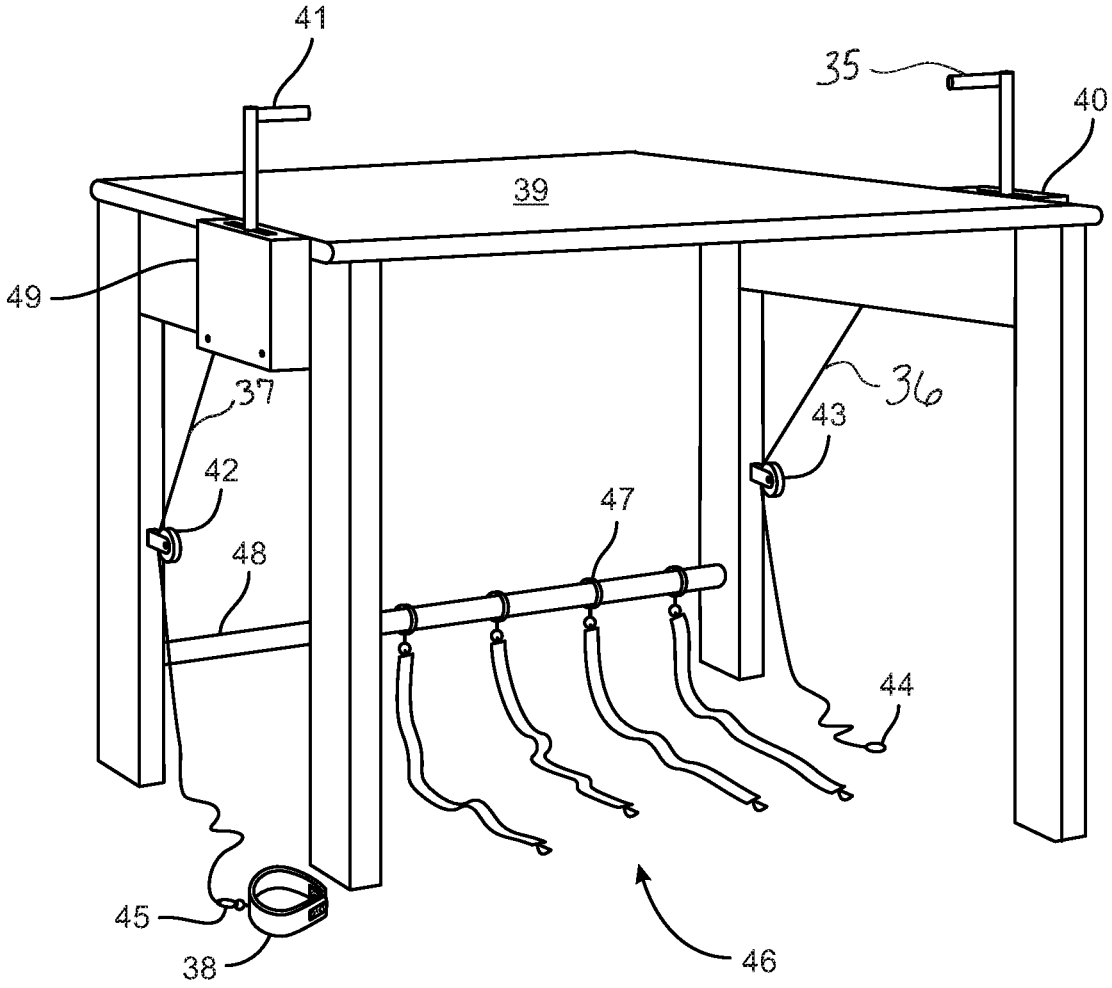
FIG. 2 shows a perspective view of an embodiment of the invention configured to use on two body parts simultaneously.

As shown in FIG. 2, a perspective view of an embodiment of the invention configured to use on two body parts simultaneously comprises a patient table 39. The table has brackets 40 and 49 attached. It is useful, though not necessary, to have two brackets so a therapy patient can work on one leg and then the other leg in one therapy session without the need to reconfigure the inventive device.

A gear like the gear 2 of FIG. 1 would be attached to each of the brackets 40, 49 though this is not shown in FIG. 2 because the brackets are enclosed. The inventive device of FIG. 2 has a bar 48 along its rear connected between the legs of the table 39. There are bar connecting rings 47 attaching the bar to bands 46, stretch bands used to exercise muscles for instance. A handle such as 35, 41 is connected to a cable 36, 37 that passes through a pulley 43, 42. At the end of the cable 36, 37 is a cable connecting ring 44, 45 attached to a cuff 38 (second cuff for left hand configuration not shown).

The device in FIG. 2 is useful in that it allows a user (not shown) to approach the device and sit upon the table 39, don the cuff 38 to a body part, an ankle for instance, and perform flexion exercises by pushing forward on the handle 41.

Figure 3:
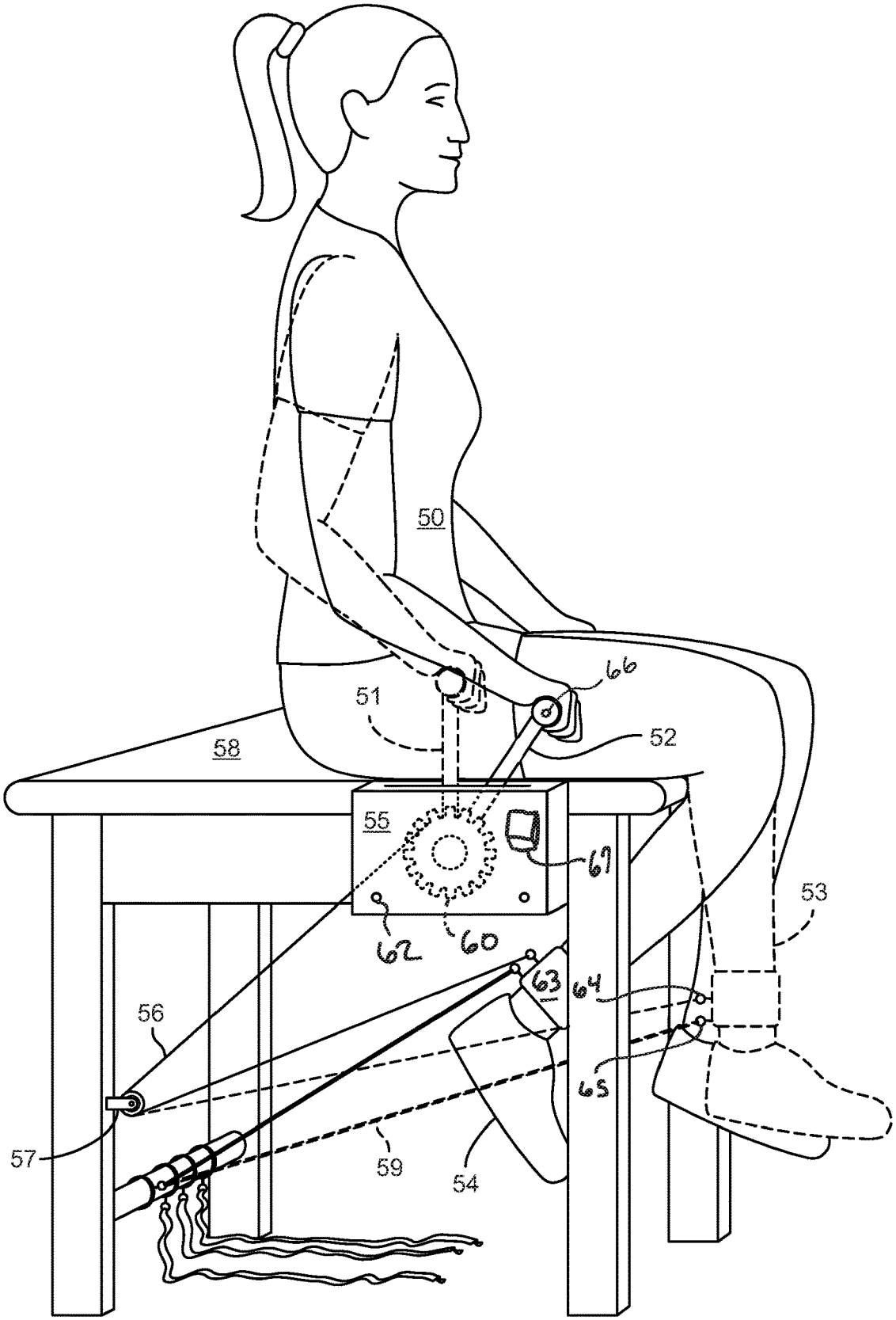
FIG. 3 shows a perspective view of an embodiment of the invention in use by a patient and showing flexion of the patient's leg.

In FIG. 3, a perspective view of an embodiment of the invention in use by a patient and showing flexion of the patient's leg comprises a patient 50 seated upon a physical therapy table 58. The patient 50 operates a handle 51 that operates a gear 60, a force transferring mechanism, which is attached to a bracket 55 via a commonly known fastener (not shown) such as a rod and bearing or a bolt with a retainer clip that allows the gear to spin. The bracket 55 is attached to the table 58 via at least one bolt 62, which is a fastening mechanism. A cable 56 is attached to the gear 60. When the patient 50 exerts force and pushes the handle forward as shown by 52, this will move and transfer the moving force through the cable 56, running through a pulley 57, and up to a cuff 63 where the cable is attached to a cable attaching ring 64. This force moves a patient's body part, here a leg, from position 53 to position 54, causing flexion of the muscles.

Too as shown in FIG. 3, the table 58 supports the attachment of stretch bands 59. The band being connected to the cuff 63 via a band connecting ring 65. This allows further exercise by the patient 50 that is different from flexion. If a patient desires to hold the flexion, they can engage a pin on the handle 66 that uses commonly known methods to hold the handle 52 in place. Additionally, the device has attached at a convenient location a counter 67, or some other metric measuring device, for the user to see an monitor.

Figure 4:
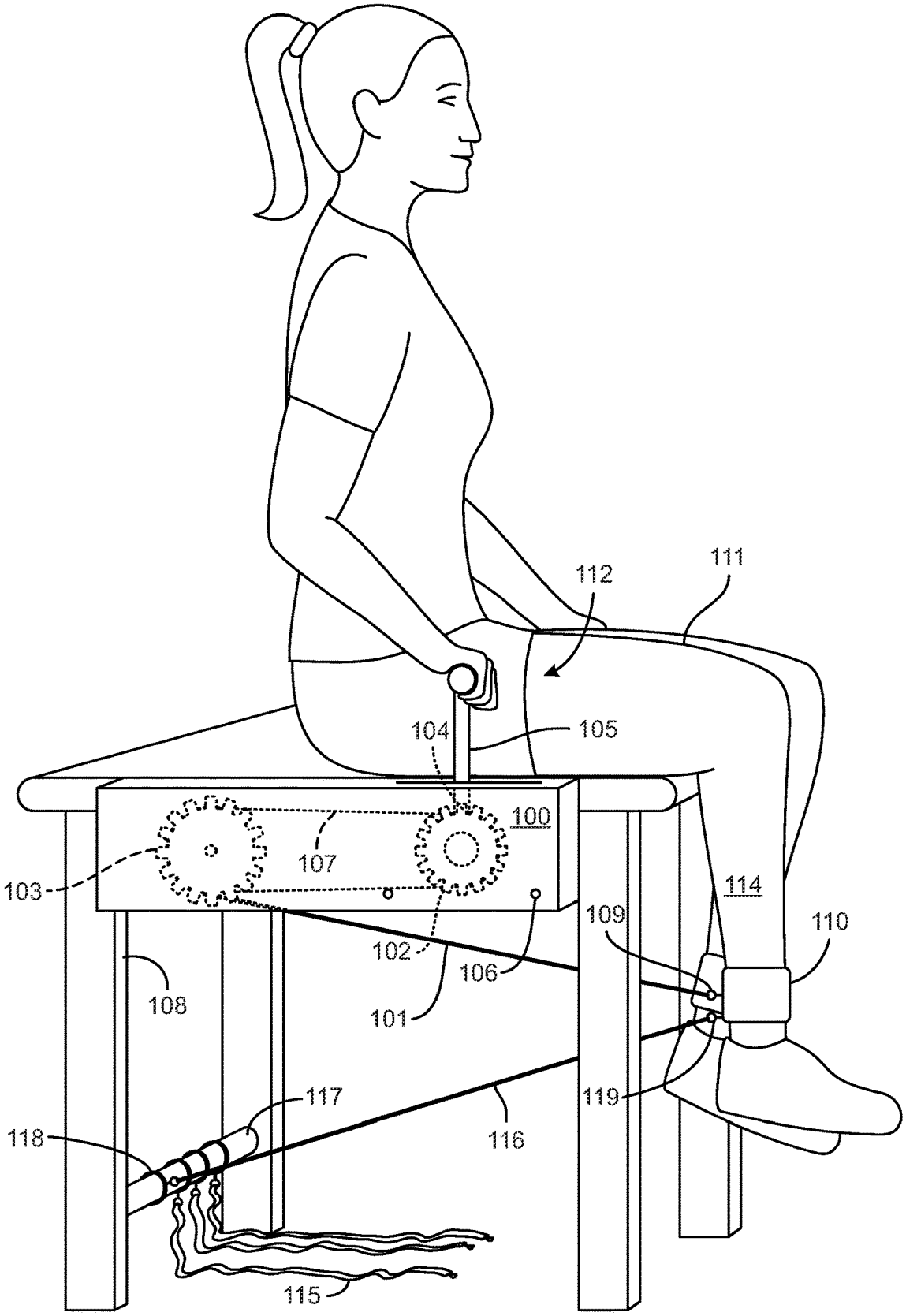
FIG. 4 shows a perspective view of another embodiment of the device in use by a patient.

As shown in FIG. 4, a perspective view of an embodiment of the device in use by a patient comprises a patient 111 seated upon a physical therapy table 108. The patient operates a handle 105 that operates a gear 102, which is part of what I call a force transferring mechanism or pulley system, which is attached to a bracket 100 via a commonly known fastener (not shown). The bracket 100 is attached to the table 108 via at least one bolt 106, which is a fastening mechanism. The pulley system is comprised of a pair of sprockets, 103 and 102, that are interconnected, in this embodiment via a chain 107. A cable 101 is attached to one of the gears 103 via a commonly known connector (not shown). When the user exerts force as shown at 112 the handle 105 attached to the other gear 102 will move and transfer the moving force to the other gear 102 which in turn will turn the interconnected gear 103 via the chain 107. The cable 101 is moved by the movement of the gear 103. I sometimes refer to gears as sprockets and vice versa. The one gear 103, unlike the pulley 7 of FIG. 1, is located at a higher point on the table 108 than the pulley 7 is attached to the table 8 of FIG. 1. The cable 101 is attached at one end to a cuff 110 via a cable connecting ring 109. The cuff 110 being removably attached to a limb 114 of the person 111. Operating the device as shown at 112 allows the person 111 to control movement of her limb 114.

Additionally as shown in FIG. 4, a bar 117 is connected between the rear legs of the table 108. There are bands 115, 116 connected to the bar 117 via at least one bar connecting ring 118. These bands are best if they are the type that are stretchable and commonly used in muscle exercise movements. The bands 116 can attach to the cuff 110 at one or more band connecting rings 119.

It easily recognized that there is a benefit in such an exercise device as described in the figures generally. The device comprises a main portion made up of a plurality of gears, 102 and 103 in FIG. 4 for instance, a hold, 5 in FIG. 1 or 105 in FIG. 4. There is possibly a pulley, such as 42 in FIG. 2 or as 3 in FIG. 1. Although, a direct driven scenario is possible where the pulley's function becomes integrated in a gear of the main portion. There is a cable and a leg attachment, such as the cuffs 10 and 110 seen in the figures. The gears 102 and 103 being integral to the main portion and the leg attachment is attachable and detachable to a body part, 114 in FIG. 4 for instance which is a person's leg near the calf. The cable having a gear end, similar to the first end in FIG. 1. The cable having a distal end, similar to the second end in FIG. 1. The distal end being connected to the leg attachment. The cable traversing the pulley, if one is used, in a path to achieve maximum flexion. The plurality of gears being interconnected, by a chain, also part of the main portion, the chain as shown by 107 of FIG. 4 for instance. The gear end being connected to one of the plurality of gears. The hold being attached to another of the plurality of gears. The hold operating the gears and causing the gears to operate the cable which thereby moves the attachment.

For instance, a user can move the hold in one direction, causing cable movement which moves the attachment. A user having the attachment connected to her calf would then experience flexion. The main portion being removably attached to a physical therapy table.

Although the present invention has been described in considerable detail with the reference to certain preferred versions thereof, other versions are possible. Therefore, the spirit and scope of the appended claims should not be limited to the description of the preferred versions contained herein.

Any element in a claim that does not explicitly state "means for" performing a specified function, or "step for" performing a specific function, is not to be interpreted as a "means" or "step" clause as specified in 35 U.S.C. § 112, ¶6.

What I claim is:

1. An exercise device comprising:

a table;

a bracket;

a fastening mechanism;

a bar connected between two legs of the table;

the fastening mechanism being a group of screws;

the bracket being attached to the table via the fastening mechanism;

a force transferring mechanism;

the force transferring mechanism being a plurality of gears;

the force transferring mechanism being attached to the bracket;

a handle;

the handle being attached to the force transferring mechanism;

the exercise device consists of a single cable;

a cuff;

the cuff having a cable connecting ring; the cuff having a band connecting ring;

the single cable being attached at a first end to the force transferring mechanism; the single cable being attached at a second end to the cable connecting ring;

the table capable of allowing a user to sit upon the table and attach the cuff to a body part of a user; and the handle being capable of altering a position of the body part as a position of the handle is altered by the user.

2. The exercise device according to claim 1 further comprising:

at least one bar connecting ring being attached to the bar;

at least one band;

the at least one band having a first band end;

the at least one band having a second band end;

the first band end being connected to one of the at least one bar connecting rings;

the second band end being connected to the band connecting ring.

3. An exercise device comprising:

a table;

a bracket;

a fastening mechanism;

the bracket being attached to the table via the fastening mechanism;

a force transferring mechanism;

the force transferring mechanism being attached to the bracket;

a handle;

the handle being attached to the force transferring mechanism;

the exercise device consists of a single cable;

the exercise device consists of a single pulley;

a cuff, the cuff having a cable connecting ring;

the cuff having a band connecting ring;

the single pulley being attached to the table;

the single cable having a first end;

the first end being attached to the force transferring mechanism;

the single cable passing through the single pulley;

the single cable having a second end;

the second end being attached to the cable connecting ring;

a bar connected between two legs of the table;

the bar located below the single pulley;

at least one bar connecting ring being attached to the bar;

at least one band;

the at least one band having a first band end;

the at least one band having a second band end;

the first band end being connected to one of the at least one bar connecting rings;

the second band end being connected to the band connecting ring;

the table capable of allowing a user to sit upon the table and attach the cuff to a body part of the user; and the handle being capable of altering a position of the body part as a position of the handle is altered by the user.

4. The exercise device according to claim 1 or 3 wherein the force transferring mechanism is rotateably attached to the bracket.

5. The exercise device of claim 3 whereby muscles of the body part being stretched when the handle alters the position of the body part.

6. The exercise device of claim 3 wherein the device is useful for performing physical therapy exercises.

7. The exercise device of claim 3 further comprising the device adapted to exert pressure against muscles of a leg to increase flexion.

8. The exercise device according to claim 1 or 3 further comprising the body part being a leg, the leg capable of being moved posteriorly as the position of the handle is altered by the user increasing the flexion of the knee.

9. The exercise device according to claim 1 or 3 further comprising a stop protruding from and being attached to the handle whereby the stop is necessarily prevented from moving further than the space occupied by the bracket to prevent the handle from moving too far and causing injury.

10. The exercise device of claim 3 wherein the device is configured such that the handle can be moved in small increments while the body part is flexed in larger increments in comparison.

11. The exercise device of claim 3 wherein the device is capable of performing static and dynamic flexion on the body part.

12. The exercise device of claim 3 further comprising the device achieving static flexion of a muscle of the body part via a pin that retains the position of the handle.

* * * * *